United States Patent [19]

Smith

[11] Patent Number: 4,461,991

[45] Date of Patent: Jul. 24, 1984

[54] CURRENT SOURCE CIRCUIT HAVING REDUCED ERROR

[75] Inventor: Michael D. Smith, Austin, Tex.

[73] Assignee: Motorola, Inc., Schaumburg, Ill.

[21] Appl. No.: 470,039

[22] Filed: Feb. 28, 1983

[51] Int. Cl.[3] ..... G05F 3/20

[52] U.S. Cl. ..... 323/312; 307/297; 323/315

[58] Field of Search ..... 307/297; 323/312, 313, 323/314, 316

[56] References Cited

U.S. PATENT DOCUMENTS 3,930,172 12/1975 Dobkin ..... 323/315 X
4,302,718 11/1981 Schade, Jr. ..... 323/315 X
4,342,926 8/1982 Whatley ..... 307/297
4,359,680 11/1982 Hellums et al. ..... 323/315 X
4,399,399 8/1983 Joseph ..... 323/315

*Primary Examiner*—William M. Shoop
*Attorney, Agent, or Firm*—Anthony J. Sarli, Jr.; Jeffrey Van Myers; Robert L. King

[57] ABSTRACT

A current source circuit which provides an output bias current having reduced error is disclosed. The current source has reference voltage and reference current portions coupled together for providing a reference current to an amplifier means. A buffer portion is coupled to the amplifier means and to a bias current portion for substantially increasing the output impedance of the amplifier portions thereby decreasing the effect of power supply variation on the output bias current.

14 Claims, 2 Drawing Figures

CURRENT SOURCE CIRCUIT HAVING REDUCED ERROR

TECHNICAL FIELD

This invention relates generally to reference circuits and, more particularly, to current reference circuits which minimize output errors resulting from variations in power supply voltage and device size matching errors.

BACKGROUND ART

Reference circuits which utilize either a base-to-emitter voltage, $V_{BE}$, or a delta $V_{BE}$ to establish a reference voltage and current by both reference voltage means and reference current means are well known. Such circuits are described in detail in U.S. Pat. No. 4,342,926 and U.S. patent application Ser. No. 330,062 filed Dec. 14, 1981. Transistor devices which are size ratioed and coupled to the reference current in a conventional current mirror structure reflect the reference current to an output device which provides a bias voltage. Although known reference circuits may be made substantially process independent, power supply voltage independence typically exists only for power supply voltages of five volts or less. This is because most of the power supply voltage generally appears across a single transistor. Due to the conventional phenomenon known as channel length modulation, the transistor which reflects the majority of power supply voltage displays a finite output impedance. As a result, a current mismatch exists between the reference voltage means and reference current means. Whenever a resistor type reference current means is utilized, the current mismatch translates into an offset voltage existing across the resistor. Further, as the supply voltage is increased, the offset voltage increases which creates a dependence on the supply voltage. Although this voltage error is generally insignificant for power supply voltages of five volts or less, the output error becomes increasingly worse at high voltage levels for N-channel conductivity devices due to the conventional impact ionization phenomenon. P-channel conductivity devices also create an offset error but the offset error is not as pronounced as it is for N-channel conductivity devices at higher voltages.

BRIEF SUMMARY OF THE INVENTION

It is an object of the present invention to provide an improved current source circuit.

Another object of the present invention is to provide a current source having reduced output error.

Yet another object of the present invention is to provide a current source having a high output impedance.

Yet a further object of the present invention is to provide a current source having reduced errors for operation at various power supply voltages.

In carrying out the above and other objects and advantages of the present invention, there is provided, in one form, a bias current reference circuit having a reference voltage established by a diode-connected device. A reference current generator is coupled to the diode-connected device to provide a reference current which is proportional to the reference voltage. A unity gain amplifier having a predetermined impedance is coupled to both the diode-connected device and reference current generator and provides a bias voltage. Bias current means are coupled to the bias voltage and provide an output bias current. Buffer means, for substantially increasing the output impedance of the unity gain amplifier and decreasing the power supply variation dependency, are coupled to both the unity gain amplifier and the bias current means.

The above and other objects, features and advantages of the present invention will be more clearly understood from the following detailed description taken in conjunction with the accompanying drawing.

Description of the Preferred Embodiment

Figure 1:
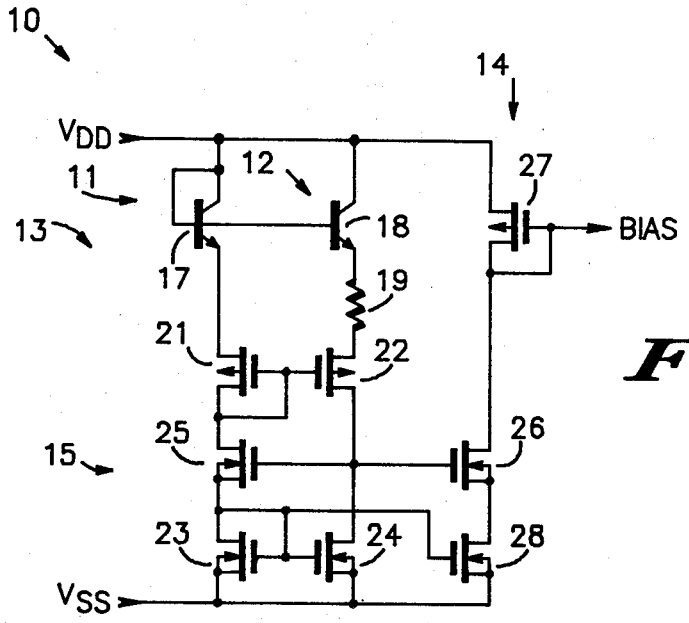
FIG. 1 illustrates in schematic form a current source circuit constructed in accordance with the preferred embodiment of the present invention.

Shown in the single drawing is a current source circuit 10 constructed in accordance with the preferred embodiment of the present invention. Current source 10 comprises generally reference voltage portion 11, reference current portion 12, unity gain amplifier portion 13, bias current portion 14 and buffer portion 15. It should readily be understood that the present invention may be practiced using any of numerous types of reference voltage means and reference current means. Two commonly known current sources utilize a base-to-emitter voltage, $V_{BE}$ and a delta $V_{BE}$ to provide a reference current. The present invention may be readily adapted for use with other types of reference voltage and current means such as a power supply and resistor. For purposes of illustration only, a current source circuit utilizing a delta $V_{BE}$ will be described. Further, while specific N-channel and P-channel MOS devices are generally shown, it should be clear that current source 10 could be implemented by completely reversing the processing techniques (e.g. N-channel to P-channel) or by using other types of transistors.

Reference voltage portion 11 comprises a diode-connected bipolar transistor 17 having both the base and collector electrodes coupled together for receiving a power supply voltage $V_{DD}$. Reference current portion 12 comprises a bipolar transistor 18 having the collector electrode thereof coupled to power supply voltage $V_{DD}$, a base electrode coupled to the base and collector electrodes of bipolar transistor 17 and an emitter electrode. The emitter electrode of transistor 18 is coupled to a first terminal of a resistor 19.

Unity gain amplifier portion 13 comprises P-channel transistors 21 and 22 and N-channel transistors 23 and 24. Buffer portion 15 comprises N-channel transistors 25 and 26. P-channel transistor 21 has a source electrode coupled to an emitter electrode of transistor 17 and a gate electrode coupled to its drain electrode, to a gate electrode of transistor 22 and to a drain electrode of transistor 25. P-channel transistor 22 has a source electrode coupled to a second terminal of resistor 19 and a drain electrode coupled to a gate electrode of transistor 25, to a gate electrode of transistor 26 and to a drain electrode of transistor 24. A source electrode of transistor 25 is coupled to both a drain electrode and a gate electrode of transistor 23 and to a gate electrode of transistor 24. Transistors 23 and 24 each have a source electrode coupled to a second supply voltage $V_{SS}$ which is more negative than supply voltage $V_{DD}$.

Therefore, transistors 21 and 23 are effectively coupled as diodes.

Bias current portion 14 comprises a P-channel transistor 27 and an N-channel transistor 28. Transistor 27 has a source electrode coupled to supply voltage $V_{DD}$ and both a gate electrode and a drain electrode coupled together to provide an output bias reference voltage. A drain electrode of transistor 26 of buffer portion 15 is coupled to the drain electrode of transistor 27 and a source electrode of transistor 26 is coupled to a drain electrode of transistor 28. A gate electrode of transistor 28 is coupled to the gate electrodes of transistors 23 and 24 and the drain electrode of transistor 23. A source electrode of transistor 28 is coupled to supply voltage $V_{SS}$.

In a preferred form, each source electrode of N-channel transistors 23, 24, 25, 26 and 28 is coupled to the respective substrate thereof. Although the present invention may be practiced without connecting the source electrode and substrate of each of these transistors, the threshold voltage of each transistor connected in this manner is effectively lowered. Therefore, a lower voltage is required to make N-channel transistors 23, 24, 25, 26 and 28 conductive which allows for a greater voltage operation.

In operation, transistor 17 provides a fixed reference voltage which is equal to the $V_{BE}$ of transistor 17. Transistor 18 also has a base-to-emitter voltage associated therewith. To utilize a delta $V_{BE}$ current source, the current densities of transistors 17 and 18 must be different so that transistors 17 and 18 have a different $V_{BE}$ voltage. Applying Kirchoff's voltage law to the loop formed by transistors 17, 18, 21 and 22 and resistor 19, if transistors 21 and 22 are matched devices having equal current densities, it can be readily shown that the voltage across resistor 19 is equal to the difference between the base-to-emitter voltages of transistors 17 and 18, delta $V_{BE}$. Resistor 19 therefore provides an accurate reference current through transistors 22 and 24. A proportional reference current is mirrored or reflected through series-connected transistors 21, 25 and 23.

Transistors 23, 24 and 25 function as a current source. Since transistors 17, 21 and 23 are connected functionally as diodes, the majority of the voltage potential between $V_{DD}$ and $V_{SS}$ is across the drain and source electrodes of transistor 25. Transistors 23 and 24 have a substantially constant voltage potential existing across the current electrodes thereof. The voltage potential across the drain and source electrodes of transistor 24 is the sum of the gate to source voltage of transistor 24 and the gate to source voltage of transistor 25. The voltage potential across the drain and source electrodes of transistor 23 is the gate to source voltage of transistor 23. Thus transistor 25 buffers transistor 23 from most of the voltage potential between $V_{DD}$ and $V_{SS}$ by having most of the voltage potential across its drain and source electrodes.

To establish the output bias reference voltage at the gate electrode of transistor 27, transistor 28 is coupled to transistor 23 so that a bias current, I, flows through transistor 28. Bias current I is proportional to or is the same current which flows through transistor 23. Further, substantially the same voltage which appears across the gate and source electrodes of transistor 23 also appears across the gate and source electrodes of transistor 28. Transistor 26 is a cascode device and performs an analogous function to transistor 25 by having most of the voltage potential between $V_{DD}$ and $V_{SS}$ across its drain and source electrodes instead of this voltage appearing across transistor 28. By applying Kirchoff's voltage law to the loop formed by transistors 23, 25, 26 and 28, it can be readily seen that the voltage which exists across the gate and source electrodes of transistor 25 and 26 are substantially equal in magnitude. Since the drain to source voltage of each of transistors 23, 24 and 28 is small in comparison with the voltage differential of $V_{DD}$ and $V_{SS}$, the natural impedance of each transistor is large and is therefore not decreased by impact ionization. Additionally, by having a small drain to source voltage across each of transistors 23, 24 and 28, the effect of matching errors associated with these transistors is minimized. Further, transistors 25 and 26 absorb any variation in the difference between $V_{DD}$ and $V_{SS}$ without affecting the current through each transistor. Therefore, the effective impedance of current source 20 is greatly increased.

To fully appreciate the advantages of the higher effective impedance provided by buffer portion 15, consider the operation of current source 10 without transistors 25 and 26, without transistor 23 being diode-connected and with transistor 24 being diode-connected. In such a circuit configuration, the voltage across transistor 23 is typically much higher than the voltage across transistor 24 which is diode-connected. Due to the fact that transistors 23 and 24 have a finite output impedance caused by channel length modulation, the current mismatch between transistors 23 and 24 translates into an offset voltage across resistor 19 which provides an error in the output bias current. As the voltage across the drain electrode of transistor 23 increases, the amount of offset voltage across resistor 19 increases proportionately. The output bias voltage error becomes more pronounced at high voltage levels on N-channel transistors due to impact ionization. Impact ionization is a phenomenon in which charge carriers are lost to the substrate at increasingly higher drain to source voltage potentials thereby decreasing the impedance of the transistors. The effect of a reduced transistor impedance is an increase in the offset voltage across resistor 19 which thereby increases the output bias current, I.

Figure 2:
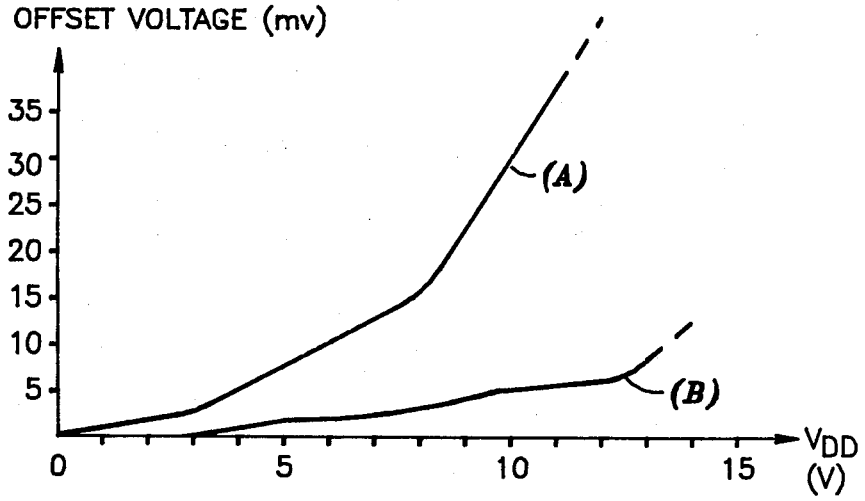
FIG. 2 illustrates in graphical form a reduction in output bias current error provided by the present invention.

Shown in FIG. 2 is a graph which illustrates in curve (A) the offset voltage across resistor 19 for a range of $V_{DD}$ supply voltages if transistors 25 and 26 are removed from current source 10 and if transistor 24 is diode-connected and transistor 23 is not diode-connected. Also shown in curve (B) of FIG. 2 is a graph illustrating the offset voltage across resistor 19 for the same range of $V_{DD}$ supply voltages for the present invention illustrated in FIG. 1. As can be readily seen, a substantial reduction in offset voltage and therefore supply voltage dependency and output bias current error is achieved by the present invention.

It should be readily apparent that in order to prevent the possibility of an inactive state, a conventional start-up circuit (not shown) is required to allow start-up current to flow through reference voltage portion 11 when the output bias is below a predetermined threshold.

While the invention has been described in the context of a preferred embodiment, it will be apparent to those skilled in the art that the present invention may be modified in numerous ways and may assume many embodiments other than that specifically set out and described above. Accordingly, it is intended by the appended claims to cover all modifications of the invention which fall within the true spirit and scope of the invention.

I claim:

1. A current source circuit having reduced error, comprising:

reference voltage means having a diode-connected device, for providing a reference voltage proportional to a bias current;

reference current means coupled to the reference voltage means, for providing a reference current proportional to the reference voltage;

unity gain amplifier means having a predetermined output impedance coupled to both said reference voltage and said reference current means, for providing a bias voltage proportional to said reference current;

bias current means coupled to said unity gain amplifier means, for providing an output bias current proportional to said bias voltage; and buffer means coupled to both said unity gain amplifier means and said bias current means, for substantially increasing the output impedance of said unity gain amplifier thereby decreasing power supply variation dependency.

2. The current source circuit of claim 1 wherein said reference current means comprise:

a first transistor having a first current electrode coupled to a first power supply voltage terminal for receiving a first supply voltage, a control electrode coupled to said reference voltage means, and a second current electrode; and resistance means having a first terminal coupled to the second current electrode of said first transistor and a second terminal coupled to said unity gain amplifier means.

3. The current source circuit of claim 2 wherein the diode-connected device of said reference voltage means is a second transistor having both a first current electrode and a control electrode coupled to the first supply voltage and a second current electrode coupled to said unity gain amplifier means.

4. The current source circuit of claim 3 wherein said first and second transistors are bipolar transistors.

5. The current source circuit of claim 3 wherein said unity gain amplifier means comprise:

a third transistor of a first conductivity type having a first current electrode coupled to the second current electrode of said second transistor, a second current electrode coupled to both a control electrode thereof and to said buffer means;

a fourth transistor of said first conductivity type having a first current electrode coupled to the second terminal of said resistance means, a control electrode coupled to both the control electrode and second current electrode of said third transistor and to said unity gain amplifier means, and a second current electrode;

a fifth transistor of a second conductivity type having a first current electrode coupled to the second current electrode of said fourth transistor and to said buffer means, a second current electrode coupled to a second supply voltage terminal for receiving a second supply voltage, and a oontrol electrode; and a sixth transistor of said second conductivity type having a first current electrode coupled to a control electrode thereof, to the control electrode of said fifth transistor, to said buffer means and to said bias current means, and a second current electrode coupled to the second supply voltage terminal.

6. The current source circuit of claim 5 wherein said buffer means comprise:

a seventh transistor of said second conductivity type having a first current electrode coupled to the second current electrode of said third transistor, a second current electrode coupled to the first current electrode of said sixth transistor, and a control electrode; and an eighth transistor of said second conductivity type having first and second current electrodes coupled to said bias current means, and a control electrode coupled to the control electrode of said seventh transistor, to the second current electrode of said fourth transistor and to the first current electrode of said fifth transistor.

7. The current source circuit of claim 6 wherein said bias current means comprise:

a ninth transistor of said first conductivity type having a first current electrode coupled to said first supply voltage terminal, and a control electrode coupled to both a second current electrode thereof and the first current electrode of said eighth transistor, for providing an output voltage proportional to said output bias current; and a tenth transistor of said second conductivity type having a first current electrode coupled to the second current electrode of said eighth transistor, a control electrode coupled to the control electrodes of said fifth and sixth transistors and to the first current electrode of said sixth transistor, and a second current electrode coupled to said second supply voltage.

8. The current source circuit of claim 7 wherein at least one of said fifth, sixth, seventh, eighth and tenth transistors has its second current electrode connected to the substrate thereof, thereby reducing its threshold voltage.

9. A delta $V_{BE}$ current source circuit comprising:

reference voltage means comprising a first bipolar transistor, for providing a reference voltage proportional to a bias current;

reference current means coupled to the reference voltage means comprising a second bipolar transistor coupled in series with a resistor, for providing a reference current proportional to the ratio of the difference in the base to emitter voltages, delta $V_{BE}$, of said first and second bipolar transistors and proportional to the resistance of said resistor;

amplifier means having a predetermined output impedance coupled to both said reference voltage and said reference current means, for providing a bias voltage proportional to said reference current;

bias current means coupled to said amplifier means, for providing an output bias current proportional to said bias voltage; and buffer means coupled to both said amplifier means and to said bias current means, for substantially increasing the output impedance of said amplifier means thereby decreasing power supply variation dependency.

10. The delta $V_{BE}$ current source of claim 9 wherein said amplifier means comprises:

a third transistor of a first conductivity type having a first current electrode coupled to the first bipolar transistor, and a control electrode coupled to both a second current electrode and said amplifier means;

a fourth transistor of said first conductivity type having a first conductivity type having a first current electrode coupled to said resistor, a control electrode coupled to the control electrode of said third transistor, and a second current electrode coupled to said amplifier means;

a fifth transistor of a second conductivity type having a first current electrode coupled to the second current electrode of said fourth transistor, a second current electrode coupled to a supply voltage terminal for receiving a supply voltage, and a control electrode coupled to both said buffer means and said bias current means; and a sixth transistor of said second conductivity type having a first current electrode coupled to both a control electrode thereof and the control electrode of said fifth transistor, and a second control electrode coupled to said supply voltage terminal.

11. The delta $V_{BE}$ current source of claim 9 wherein said buffer means comprise:

a seventh transistor of said second conductivity type having a first current electrode coupled to the second current electrode of said third transistor, a control electrode coupled to the second current electrode of said fourth transistor and to the first current electrode of said fifth transistor, and a second current electrode coupled to the first current electrode of said sixth transistor; and an eighth transistor of said second conductivity type having a control electrode coupled to the control electrode of said seventh transistor, and first and second current electrodes coupled to said bias current means.

12. The delta $V_{BE}$ current source of claim 9 wherein said bias current means comprise:

a ninth transistor of said first conductivity type having a first current electrode coupled to both said reference voltage means and said reference current means, and both a control electrode and a second current electrode coupled to the first current electrode of said eighth transistor; and a tenth transistor of said second conductivity type having a first current electrode coupled to the second current electrode of said eighth transistor, a control electrode coupled to the control electrodes of said fifth and sixth transistors, and a second current electrode coupled to said supply voltage terminal.

13. A current source circuit having reduced error, comprising:

reference voltage means having a diode-connected device, for providing a reference voltage proportional to a bias current provided by a first power supply voltage;

reference current means coupled to the reference voltage means, for providing a reference current proportional to the reference voltage;

a first transistor having a first current electrode coviding a reference current proportional to the reference voltage;

a first transistor having a first current electrode coupled to said reference voltage means, and a control electrode coupled to a second current electrode;

a second transistor having a first current electrode coupled to said reference current means, a control electrode coupled to the control electrode of said first transistor, and a second current electrode;

a third transistor having a first current electrode coupled to the second current electrode of said first transistor, a control electrode coupled to the second current electrode of said second transistor, and a second current electrode;

a fourth transistor having a first current electrode coupled to the second current electrode of the third transistor and to a control electrode thereof, and a second current electrode coupled to a second supply voltage terminal for receiving a second supply voltage;

a fifth transistor having a first current electrode coupled to both the second current electrode of the second transistor and the control electrode of said third transistor, a control electrode coupled to the control electrode of said fourth transistor, and a second current electrode coupled to the second supply voltage terminal;

a sixth transistor having a first current electrode coupled to a first supply voltage terminal for receiving said first supply voltage, and a control electrode coupled to a second current electrode, for providing an output bias voltage;

a seventh transistor having a first current electrode coupled to the second current electrode of said sixth transistor, a control electrode coupled to the control electrode of said third transistor, and a second current electrode; and an eighth transistor having a first current electrode coupled to the second current electrode of said seventh transistor, a gate electrode coupled to the gate electrodes of said fourth and fifth transistors, and a second current electrode coupled to said second supply voltage terminal.

14. The current source of claim 13 wherein at least one of said eight transistors has its second current electrode to the substrate thereof, thereby reducing its threshold voltage.

* * * * *